US006876916B2

(12) United States Patent
Cullen

(10) Patent No.: US 6,876,916 B2
(45) Date of Patent: Apr. 5, 2005

(54) METHOD AND SYSTEM FOR INFERRING TORQUE OUTPUT OF A VARIABLE COMPRESSION RATIO ENGINE

(75) Inventor: Michael John Cullen, Northville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 486 days.

(21) Appl. No.: 09/683,680

(22) Filed: Feb. 1, 2002

(65) Prior Publication Data

US 2004/0210377 A1 Oct. 21, 2004

(51) Int. Cl.[7] ..... F02D 45/00
(52) U.S. Cl. ..... 701/102
(58) Field of Search ..... 701/101, 102, 701/110, 114, 115; 73/115, 116, 117.3

(56) References Cited

U.S. PATENT DOCUMENTS

| | | | |
|---|---|---|---|
| 4,246,873 | A | 1/1981 | Lih-Liaw |
| 4,286,552 | A | 9/1981 | Tsutsumi |
| 4,469,055 | A | 9/1984 | Caswell |
| 4,505,152 | A | 3/1985 | Haddox |
| 4,805,571 | A | 2/1989 | Humphrey |
| 4,834,031 | A | 5/1989 | Katoh et al. |
| 4,860,711 | A | 8/1989 | Morikawa |
| 5,146,879 | A | 9/1992 | Kume et al. |
| 5,165,368 | A | 11/1992 | Schechter |
| 5,241,855 | A | 9/1993 | Cullen et al. |
| 5,255,637 | A | 10/1993 | Schechter |
| 5,287,827 | A | 2/1994 | Almendinger et al. |
| 5,417,185 | A | 5/1995 | Beattie |
| 5,562,068 | A | 10/1996 | Sugimoto et al. |
| 5,595,146 | A | 1/1997 | Bollig et al. |
| 5,682,854 | A | 11/1997 | Ozawa |
| 5,724,863 | A | 3/1998 | Kramer et al. |
| 5,791,302 | A | 8/1998 | Ma |
| 5,819,702 | A | 10/1998 | Mendler |
| 5,845,613 | A | 12/1998 | Yoshikawa |
| 5,862,790 | A | 1/1999 | Dai et al. |
| 5,865,092 | A | 2/1999 | Woudwyk |
| 5,960,750 | A | 10/1999 | Kreuter |
| 6,115,664 | A | 9/2000 | Cullen et al. |
| 6,125,801 | A | 10/2000 | Mendler |
| 6,135,086 | A | 10/2000 | Clarke et al. |
| 6,564,769 | B2 * | 5/2003 | Kolmanovsky et al. ..... 123/295 |

FOREIGN PATENT DOCUMENTS

| | | | |
|---|---|---|---|
| JP | 3-92552 | A | 4/1991 |

OTHER PUBLICATIONS

U.S. Appl. No. 09/682,263 filed Aug. 10, 2001 "Connecting Rod for a Variable Compression Engine", Rao et al.
U.S. Appl. No. 09/993,141 filed Nov. 6, 2001 "Diagnostic Method for Variable Compression Ratio Engine".

* cited by examiner

*Primary Examiner*—Andrew M. Dolinar
(74) *Attorney, Agent, or Firm*—Dykema Gossett PLLC; Carlos Hanze

(57) ABSTRACT

A method for operating a variable compression ratio internal combustion engine includes the steps of determining a compression ratio operating state of the engine, and inferring a torque output for the engine based at least in part on the compression ratio operating state of the engine. For example, brake engine torque can be computed by first determining a compression ratio operating state, rotational speed and air flow of the engine, and selecting predetermined baseline indicated torque and baseline engine friction loss values based on the engine speed, the air flow and compression ratio operating state. The baseline indicated torque and baseline engine friction loss values are then used to estimate the brake engine torque.

17 Claims, 4 Drawing Sheets

METHOD AND SYSTEM FOR INFERRING TORQUE OUTPUT OF A VARIABLE COMPRESSION RATIO ENGINE

BACKGROUND OF INVENTION

1. Field of the Invention

The present invention relates generally to variable compression ratio internal combustion engines. More particularly, the invention relates to a method and system for determining the torque output of a variable compression ratio internal combustion engine.

2. Background Art

The "compression ratio" of an internal combustion engine is defined as the ratio of the cylinder volume when the piston is at bottom-dead-center (BDC) to the cylinder volume when the piston is at top-dead-center (TDC). Generally, the higher the compression ratio, the higher the thermal efficiency and fuel economy of the internal combustion engine. So-called "variable compression ratio" internal combustion engines have been developed, for example, having higher compression ratios during low load conditions and lower compression ratios during high load conditions. Various techniques have been disclosed for varying compression ratio, including for example, using "sub-chambers and "sub-pistons" to vary the volume of a cylinder, see for example patents U.S. Pat. No. 4,246,873 and U.S. Pat. No. 4,286,552; varying the actual dimensions of all or a portion of a piston attached to a fixed length connecting rod, see U.S. Pat. No. 5,865,092; varying the actual length of the connecting rod itself, see U.S. Pat. Nos. 5,724,863 and 5,146,879; and using eccentric rings or bushings either at the lower "large" end of a connecting rod or the upper "small" end of the connecting rod for varying the length of the connecting rod or height of the reciprocating piston, see U.S. Pat. No. 5,562,068, U.S. Pat. No. 5,960,750, U.S. Pat. No. 5,417,185 and Japanese Publication JP-03092552.

As with conventional internal combustion engines, it is vitally important for a number of reasons to be able to accurately estimate the output torque of a variable compression ratio internal combustion engine. Torque estimates are used, for example, to schedule hydraulic line pressures in a step ratio transmission, prevent transmission braking in certain gears by limiting peak torque, and to coordinate operation of a vehicle's anti-lock braking system so as to minimize wheel slip. In vehicles having multiple torque sources, for example hybrid electric vehicles, torque estimates are required in order to properly coordinate and arbitrate the various torque sources onboard the vehicle.

The inventor herein has recognized the need to accurately determine the output torque as a function of a selected engine compression ratio in order to ensure optimal control and performance of the engine and corresponding motor vehicle.

SUMMARY OF INVENTION

A method is provided for operating a variable compression ratio internal combustion engine. The method includes the steps of determining a compression ratio operating state of the variable compression ratio internal combustion engine, and inferring a torque output for the engine based at least in part on the compression ratio operating state of the engine. For example, in accordance with the present invention, brake engine torque can be inferred by determining an engine speed, air flow and current compression ratio operating state of the engine, and then selecting both a baseline indicated torque value and a baseline engine friction loss value based on the speed, air flow and compression ratio operating state of the engine. The baseline indicated torque and engine friction loss values are modified according to operating conditions and parameters of the engine, and then used to determine the brake engine torque.

Advantageously, the methods described herein allow for improved estimates of engine output torque that can be used to optimize scheduling of compression ratio operating states in a variable compression ratio internal combustion engine. The methods disclosed herein are useful for optimizing the fuel economy benefits of the engine, while at the same time improving control and performance of a corresponding motor vehicle and related components and subsystems.

In accordance with a related aspect of the present invention, a corresponding system is provided for operating a variable compression ratio internal combustion engine. The system includes a compression ratio setting apparatus for configuring the engine in selected ones of the compression ratio operating states, and a controller in communication with the sensors and the compression ratio apparatus, the controller comprising computer program means for inferring a torque output for the engine based at least in part on the compression ratio operating state of the engine. The system in accordance with a preferred embodiment further includes a sensor coupled to the engine for generating a signal representative of engine speed, a sensor coupled to the engine for generating a signal representative of air flow into the engine; and computer program code and look-up tables for determining at least one predefined indicated torque value based on the engine speed, the air flow and the compression ratio operating state of the engine; and computer program code and look-up tables for determining at least one predefined engine friction loss value based on the engine speed, the air flow and the compression ratio operating state of the engine. The system further includes computer program code for estimating a brake torque of the engine using the indicated torque and baseline engine friction loss values.

Further advantages, objects and features of the invention will become apparent from the following detailed description of the invention taken in conjunction with the accompanying figures showing illustrative embodiments of the invention.

BRIEF DESCRIPTION OF DRAWINGS

For a complete understanding of the present invention and the advantages thereof, reference is now made to the following description taken in conjunction with the accompanying drawings in which like reference numerals indicate like features wherein.

DETAILED DESCRIPTION

Figure 1:
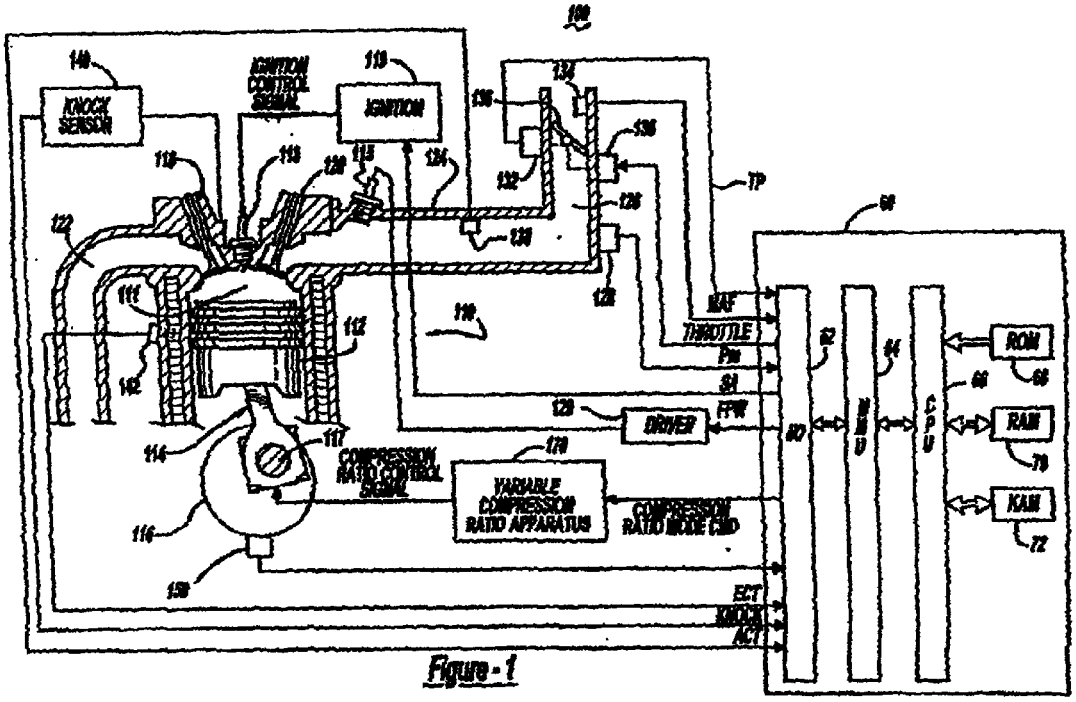
FIG. 1 is a diagram of an exemplary variable compression ratio internal combustion engine in accordance with the present invention.

FIG. 1 shows an exemplary variable compression ratio internal combustion engine in accordance with the present invention. As will be appreciated by those of ordinary skill in the art, the present invention is independent of the particular underlying engine configuration and component designs, and as such can be used with a variety of different internal combustion engines having more than one compression ratio operating modes. The engine for example can be constructed and operated as a discrete compression ratio engine operating for example at a high compression or at low compression, or as a continuously variable compression ratio engine capable of operating at a any number of discrete or selected compression ratios. Similarly, the present invention is not limited to any particular type of apparatus or method required for setting or varying the compression ratio of the internal combustion engine.

Referring again to FIG. 1, the engine 110 includes a plurality of cylinders (only one shown), each having a combustion chamber 111, a reciprocating piston 112, and intake and exhaust valves 120 and 118 for communicating the combustion chamber 111 with intake and exhaust manifolds 124 and 122. The piston 112 is coupled to a connecting rod 114, which itself is coupled to a crankpin 117 of a crankshaft 116. Fuel is provided to the combustion chamber 111 via a fuel injector 115 and is delivered in proportion to a fuel pulse width (FPW) determined by an electronic engine or vehicle controller 60 (or equivalent microprocessor-based controller) and electronic driver circuit 129. Air charge into the intake manifold 124 is nominally provided via an electronically controlled throttle plate 136 disposed within throttle body 126. Ignition spark is provided to the combustion chamber 111 via spark plug 113 and ignition system 119 in accordance with a spark advance (or retard) signal (SA) from the electronic controller 60.

As shown in FIG. 1, the controller 60 nominally includes a microprocessor or central processing unit (CPU) 66 in communication with computer readable storage devices 68, 70 and 72 via memory management unit (MMU) 64. The MMU 64 communicates data (including executable code instructions) to and from the CPU 66 and among the computer readable storage devices, which for example may include read-only memory (ROM) 68, random-access memory (RAM) 70, keep-alive memory (KAM) 72 and other memory devices required for volatile or non-volatile data storage. The computer readable storage devices may be implemented using any known memory devices such as programmable read-only memory (PROM's), electrically programmable read-only memory (EPROM's), electrically erasable PROM (EEPROM's), flash memory, or any other electrical, magnetic, optical or combination memory devices capable of storing data, including executable code, used by the CPU 66 for controlling the internal combustion engine and/or motor vehicle containing the internal combustion engine. Input/output (I/O) interface 62 is provided for communicating with various sensors, actuators and control circuits, including but not limited to the devices shown in FIG. 1. These devices include an engine speed sensor 150, electronic fuel control driver 129, ignition system 119, manifold absolute pressure sensor (MAP) 128, mass air flow sensor (MAF, "airmeter") 134, throttle position sensor 132, electronic throttle control motor 130, inlet air temperature sensor 138, engine knock sensor 140, and engine coolant temperature 142.

The engine 110 of FIG. 1 also includes and a variable compression ratio ("compression ratio setting") apparatus 170. In a non-limiting embodiment, the variable compression ratio apparatus 170 is operated to vary the effective length of the connecting rod 114, and thus the clearance volume and compression ratio of the engine. Such an apparatus is described, for example, in U.S. Pat. No. 6,394,047 entitled "Connecting Rod for a Variable Compression Engine," which is owned by the assignee of the present invention and is hereby incorporated by reference in its entirety. The actual construction and configuration of the variable compression apparatus shown in FIG. 1 is not at all intended to limit the scope of claim protection for the inventions described herein.

In a non-limiting aspect of the present invention, the variable compression ratio apparatus of FIG. 1 is described below as operating in a "high" compression ratio mode (compression ratio of 13:1 and above) or a "low" compression ratio mode (compression ratio of 11:1 and below).

Figure 2:
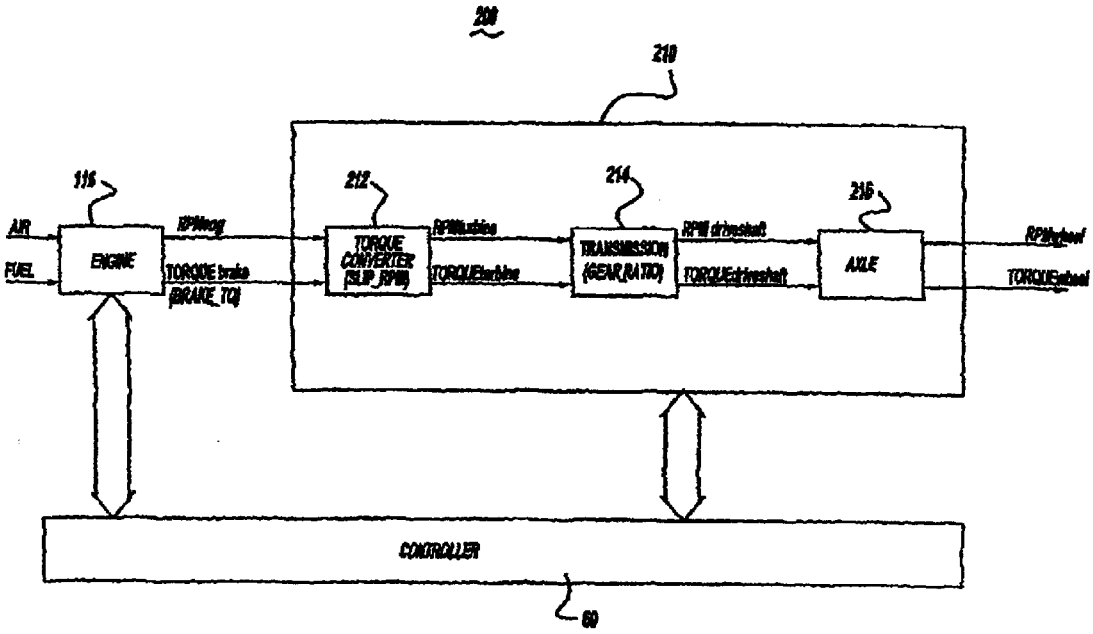
FIG. 2 is a block diagram showing the engine and controller of FIG. 1 coupled to a driveline of a motor vehicle.

FIG. 2 shows a high-level block diagram of the engine 110 and controller 60 of FIG. 1 coupled to a driveline 210 of a motor vehicle. The controller 60 is shown as a powertrain control module for controlling both engine and driveline operations for the motor vehicle. The driveline 210, by way of example and not limitation, includes a torque converter 212, a vehicle transmission 214, and axle 216. The driveline however may include other conventional vehicle driveline components such as the driveshaft, suspension, brakes, etc.

As shown in FIG. 2, the engine 110 generates engine speed and torque outputs $RPM_{eng}$ and $TORQUE_{Brake}$ in response to a commanded air/fuel mixture. $TORQUE_{Brake}$ is commonly referred to as "brake engine torque" and can be derived using estimates of engine indicated torque and engine frictional losses. $TORQUE_{Brake}$ (also shown as BRAKE_TQ in FIGS. 2 through 4) can be estimated, for example, using the method described in U.S. Pat. No. 5,241,855, entitled "Method and Apparatus for Inferring Engine Torque," which is also owned by the assignee of the present invention and is hereby incorporated by reference in its entirety. The torque converter 212 then converts $TORQUE_{Brake}$ to converter output torque $TORQUE_{Turbine}$, and subject to driveline frictional losses, is transmitted through the transmission 214 to generate a driveshaft torque $TORQUE_{Driveshaft}$ and driveshaft rotational speed $RPM_{Driveshaft}$. SLIP_RPM in block 212 represents the difference between engine rotational speed and the rotational speed of a torque converter turbine, and GEAR_RATIO in block 214 the gear ratio of the vehicle transmission. Subject to additional driveline losses, $TORQUE_{Driveshaft}$ is transmitted through the axle 216 to yield wheel torque $TORQUE_{Wheel}$ and corresponding wheel rotational speed $RPM_{Wheel}$. As such, if the engine indicated torque, brake torque and frictional losses of the engine and driveline are known, the vehicle speed and torque outputs $RPM_{Wheel}$ and $TORQUE_{Wheel}$ at the wheels can be estimated.

Figure 3:
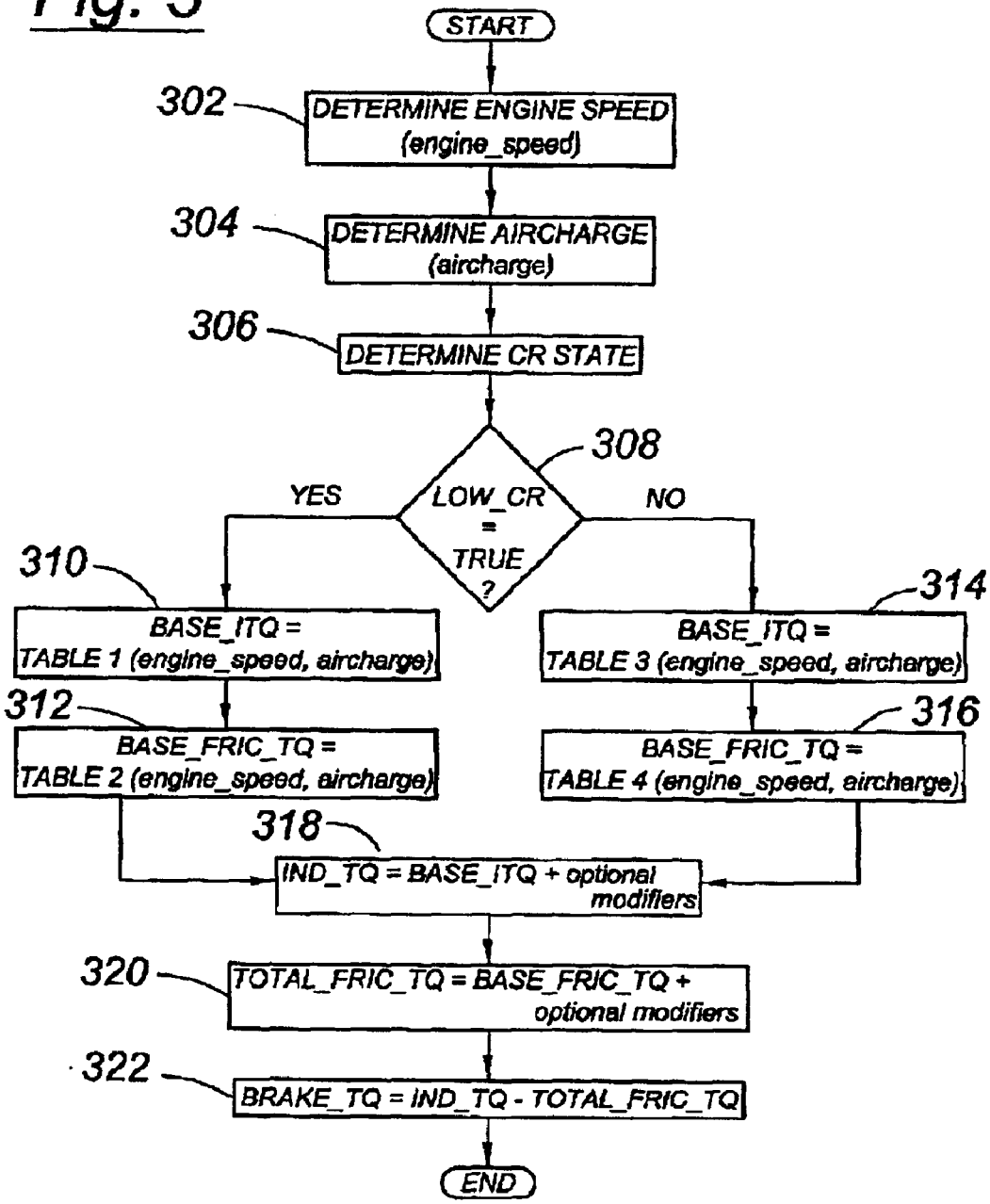
FIG. 3 is a flow diagram of a preferred method for operating a discretely variable compression ratio internal combustion engine in accordance with the present invention.
Figure 4:
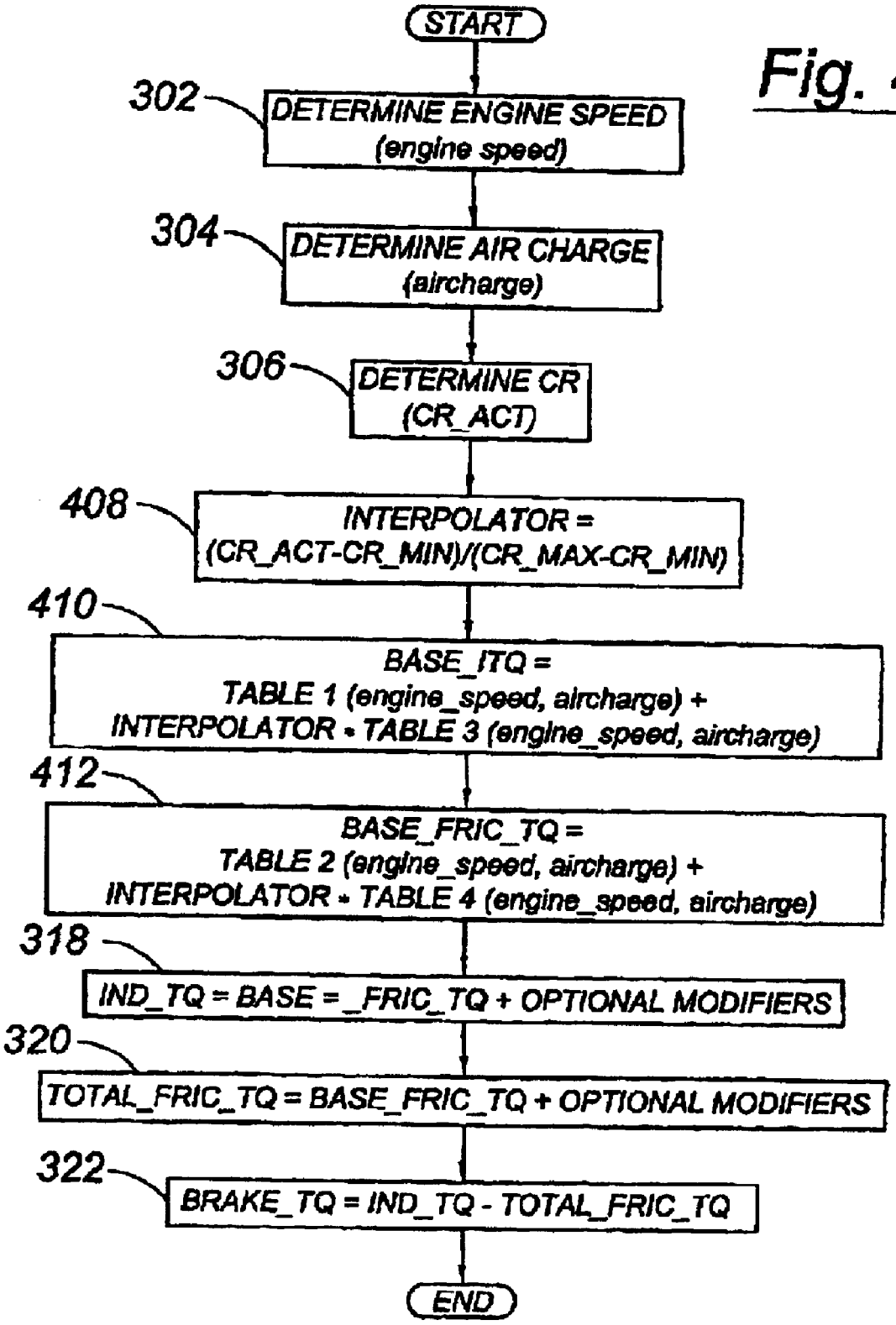
FIG. 4 is a flow diagram of a preferred method for operating a continuously variable compression ratio internal combustion engine in accordance with the present invention.

FIGS. 3 and 4 show flow diagrams of preferred methods for operating a variable compression ratio internal combustion engine in accordance with the present invention. The method of FIG. 3 is applicable to variable compression ratio internal combustion engines operating in discrete compression ratio states, for example the engine described above with reference to FIG. 1, and the method of FIG. 4 is applicable to a continuously variable compression ratio internal combustion engine having for example "HI" and "LOW" states representing minimum and maximum limits on a continuous range of compression ratio states. The scope of the present invention however is not intended to be limited to a particular type of engine or compression ratio setting apparatus.

Referring now to FIG. 3, a preferred method for operating a discretely variable compression ratio internal combustion engine includes the steps of determining the rotational speed ($RPM_{eng}$ or engine_speed) of the engine, step 302, determining the air flow (aircharge) into the engine, step 304, and determining the compression ratio operating stare of the engine, step 306. Engine_speed can be determined using a speed sensor coupled to an engine crankshaft, as shown for example in FIG. 1, or any other method known in the art. Aircharge is also determined using any known method, including for example using a MAF sensor disposed in the engine intake manifold as shown in FIG. 1. The compression ratio operating mode can be determined using any known methods, including using a combustion pressure sensor disposed in one or more of the cylinders, or by using a piston position sensor or other sensor coupled to the engine and/or the compression ratio setting apparatus of the engine. The compression ratio operating state can also be derived or inferred using any suitable method, for example as disclosed in U.S. Pat. No. 6,612,288 entitled "Diagnostic Method for Variable Compression Ratio Engine, " which are also owned by the assignee of the present invention and which are hereby incorporated by reference in their entirety. 308, then a baseline indicated torque value (Base_ITQ) at MBT spark is selected from Table 1 shown below, step 310:

TABLE 1

Baseline Indicated Torque Values (N-m) for Low Compression Ratio (ITQ_LO_CR)

| Aircharge | RPM | | | |
|---|---|---|---|---|
| (lbs/cylinder-filling) | 500 | 1000 | 2000 | 6000 |
| 0.0025 | 95 | 100 | 105 | 105 |
| 0.0020 | 75 | 80 | 85 | 86 |
| 0.0015 | 54 | 60 | 65 | 66 |
| 0.0010 | 34 | 40 | 45 | 46 |
| 0.0005 | 17 | 20 | 25 | 26 |
| 0.0000 | 0 | 0 | 0 | 0 |

Table 1 shows predetermined low compression Base_ITQ (ITQ_LO_CR) values as a function of engine speed (eng_speed) and air flow (aircharge). Engine_speed is shown in revolutions per minute (RPM), and aircharge in lbs/cylinder-filling. Aircharge is determined for example as described in U.S. Pat. No. 5,241,855 using an MAF sensor output (AM in lbs/minute) divided by the number of cylinder fillings per minute (e.g., RPM*ENGCYL/2, wherein ENGCYL is the number of available engine cylinders). The ITQ_LO_CR values shown above, as well as the predetermined high compression Base_ITQ values (ITQ_HI_CR) shown below in Table 3, can be determined experimentally and depend also on certain operating conditions and parameters of the internal combustion engine, including for example air/fuel ratio (e.g., stoichiometric), percent exhaust gas re-circulation (e.g., 0% EGR), fuel mixture (e.g., 100% gasoline) and the number of firing engine cylinders.

A baseline engine friction loss value (Base_FRIC_TQ) is then determined using Table 2, step 312:

TABLE 2

Baseline Engine Friction Loss Values (N-m) for Low Compression Ratio (FTQ_LO_CR)

| Aircharge | RPM | | | |
|---|---|---|---|---|
| (lbs/cylinder-filling) | 500 | 1000 | 2000 | 6000 |
| 0.0025 | 10 | 12 | 15 | 25 |
| 0.0020 | 12 | 14 | 17 | 24 |
| 0.0015 | 14 | 16 | 18 | 23 |
| 0.0010 | 16 | 18 | 20 | 22 |
| 0.0005 | 18 | 20 | 21 | 21 |
| 0.0000 | 20 | 22 | 23 | 20 |

Table 2 shows predetermined low compression Base_FRIC_TQ values (FTQ_LO_CR) also as a function of engine speed and air flow. The FTQ_LO_CR values shown above, as well as the predetermined high compression Base_FRIC_TQ values (FTQ_HI_CR) shown below in Table 4, can be determined experimentally and depend further on certain operating conditions and parameters of the internal combustion engine, including for example engine temperature (e.g., warmed-up engine), whether the engine is "broken-in" (e.g., friction stabilized), whether an air conditioner clutch of the vehicle is disabled, and the base pressure of a power steering system (i.e., hydraulic pressure with steering wheel in "straight ahead" position).

Referring again to FIG. 3, step 308, if the engine is operating in a high compression operating state (Low_CR= FALSE), then Base_ITQ and Base_FRIC_TQ are selected from Tables 3 and 4 respectively:

TABLE 3

Baseline Indicated Torque Values ((N-m) or High Compression Ratio (ITQ_HI_CR)

| Aircharge | RPM | | | |
|---|---|---|---|---|
| (lbs/cylinder-filling) | 500 | 1000 | 2000 | 6000 |
| 0.0025 | 103 | 108 | 113 | 112 |
| 0.0020 | 82 | 90 | 95 | 96 |
| 0.0015 | 59 | 66 | 71 | 72 |
| 0.0010 | 37 | 43 | 48 | 49 |
| 0.0005 | 19 | 23 | 28 | 29 |
| 0.0000 | 0 | 0 | 0 | 0 |

TABLE 4

Baseline Engine Friction Loss Values (N-m) for High Compression Ratio (FTQ_HI_CR)

| Aircharge | RPM | | | |
|---|---|---|---|---|
| (lbs/cylinder-filling) | 500 | 1000 | 2000 | 6000 |
| 0.0025 | 12 | 14 | 17 | 27 |
| 0.0020 | 14 | 16 | 19 | 25 |
| 0.0015 | 16 | 18 | 20 | 25 |
| 0.0010 | 18 | 20 | 22 | 24 |
| 0.0005 | 20 | 22 | 23 | 23 |
| 0.0000 | 22 | 24 | 25 | 22 |

The Base_ITQ and Base_FRIC_TQ values determined in accordance with steps 310 and 312 (or 314 and 316) can then be modified, adjusted or otherwise changed to take into account certain operating conditions and parameters of the internal combustion engine, steps 318 and 320. Base_ITQ can be modified as described for example in U.S. Pat. No.

5,241,855 using multipliers representative of one or more operating parameters and conditions of the engine. Similarly, Base_FRIC_TQ can be combined with selected miscellaneous friction loss values to compensate for variable frictional losses attributable to certain operating conditions and parameters of the internal combustion engine. The adjusted Base_ITQ and Base_FRIC_TQ values, shown as indicated torque (IND_TQ) and total engine friction loss (TOTAL_FRIC_TQ) in FIG. 3, are then used to derive a value for brake engine torque (BRAKE_TQ). In accordance with step 322, TOTAL_FRIC_TQ is subtracted from IND_TQ to derive the BRAKE_TQ estimate.

FIG. 4 shows a preferred method for operating a continuously variable compression ratio internal combustion engine in accordance with the present invention. The method is similar to the method of FIG. 3, except that Tables 1 through 4 are used at all times regardless of the compression ratio operating state of the engine.

In accordance with FIG. 4, step 408, an interpolator value is determined in accordance with Equation (1):

$$\text{Interpolator}=(\text{CR_ACT CR_MIN})/(\text{CR_MAX CR_MIN}) \quad \text{Eq. (1)},$$

wherein CR_ACT is the actual compression ratio of the internal combustion engine, CR_MIN is a minimum compression ratio, and CR_MAX is a maximum compression ratio of the engine. The interpolator value is then used along with the respective tables in accordance with Equations 2 and 3 to derive the Base_ITQ and Base_FRIC_TQ values for a continuously variable compression ratio internal combustion engine:

$$\text{Base_ITQ_TQ}=\text{ITQ_LO_CR}+\text{Interpolator}*\text{ITQ_HI_CR} \quad \text{Eq. (2)}$$

and, $$\text{Base_FRIC_TQ}=\text{FTQ_LO_CR}+\text{Interpolator}*\text{FTQ_HI_CR} \quad \text{Eq. (3)}$$

Base_ITQ and Base_FRIC_TQ values are then modified and BRAKE_TQ computed as described above with respect to steps 318, 320 and 322 of FIG. 3.

Although the present invention has been described in connection with particular embodiments thereof, it is to be understood that various modifications, alterations and adaptations may be made by those skilled in the art without departing from the spirit and scope of the invention. It is intended that the invention be limited only by the appended claims.

What is claimed is:

1. A method for operating a variable compression ratio internal combustion engine, comprising:

determining a compression ratio operating state of the engine; and inferring a torque output for the engine based at least in part on the compression ratio operating state of the engine, as well as upon the engine speed and air flow.

2. The method according to claim 1, further comprising the step of modifying the indicated torque value based on operating conditions of the engine.

3. The method according to claim 1, wherein said step of inferring the engine torque output comprises the step of determining at least one predefined engine friction loss value based on the engine speed, the air flow and the compression ratio operating state of the engine.

4. The method according to claim 3, further comprising the step of modifying the engine friction loss value based on secondary frictional losses of the engine.

5. A method for estimating an indicated torque value for an internal combustion engine having a plurality of compression ratio operating states, comprising:

determining a current compression ratio operating state of the engine;

determining an operating speed of the engine;

determining an air flow of the engine;

determining a baseline indicated torque value based on the engine speed, the air flow and compression ratio operating state of the engine; and modifying the indicated torque value based on operating conditions of the engine.

6. The method according to claim 5, wherein said step of determining the baseline indicated torque value comprises selecting at least one predefined baseline indicated torque value.

7. The method according to claim 5, wherein said step of determining the baseline indicated torque value comprises selecting a predefined baseline indicated torque value corresponding to the compression ratio operating state of the engine.

8. The method according to claim 5, wherein said step of determining the baseline indicated torque value comprises:

selecting a predefined maximum baseline indicated torque value corresponding to a maximum compression ratio operating state of the engine;

selecting a predefined minimum baseline indicated torque value corresponding to a minimum compression ratio operating state of the engine; and using said predefined maximum and minimum baseline indicated torque values to derive the baseline indicated torque value corresponding to the compression ratio operating state of the engine.

9. A method for estimating an engine friction loss for an internal combustion engine having a plurality of compression ratio operating states comprising:

determining a current compression ratio operating state of the engine;

determining an operating speed of the engine;

determining an air flow of the engine;

determining a baseline engine friction loss value based on the engine speed, the air flow and compression ratio operating state of the engine; and modifying the baseline engine friction loss value based on operating conditions of the engine.

10. The method according to claim 9, wherein said step of determining the baseline engine friction loss value comprises selecting at least one predefined baseline indicated torque value.

11. The method according to claim 9, wherein said step of determining the baseline engine friction loss value comprises selecting a predefined baseline engine friction loss value corresponding to the compression ratio operating state of the engine.

12. The method according to claim 9, wherein said step of determining the baseline engine friction lass value comprises:

selecting a predefined maximum baseline engine friction loss value corresponding to a maximum compression ratio operating state of the engine;

selecting a predefined minimum baseline engine friction loss value corresponding to a minimum compression ratio operating state of the engine; and using said predefined maximum and minimum baseline engine friction loss values to derive the baseline engine friction loss value corresponding to the compression ratio operating state of the engine.

13. A method for inferring brake engine torque of an internal combustion engine having a plurality of compression ratio operating states, comprising:

determining a current compression ratio operating state of the engine;

determining an operating speed of the engine;

determining an air flow of the engine;

determining a baseline indicated torque value based on the engine speed, the air flow and compression ratio operating state of the engine;

determining a baseline engine friction loss value based on the engine speed, the air flow and compression ratio operating state of the engine; and using the baseline indicated torque and baseline engine friction loss values to derive an estimate for the brake engine torque.

14. The method according to claim 13, comprising:

modifying one or both of the baseline indicated torque and the baseline engine friction loss value based on operating conditions of the engine;

using one or both of the modified baseline indicated torque and the baseline engine friction loss values to derive an estimate for the brake engine torque.

15. A system for operating an internal combustion engine having a plurality of compression ratio operating states, the system comprising:

a sensor coupled to the engine for generating a signal representative of engine speed;

a sensor coupled to the engine for generating a signal representative of air flow into the engine;

wherein computer program means for inferring a torque output for the engine comprises:

computer program means for determining at least one predefined engine friction loss value based on the engine speed, the air flow and the compression ratio operating state of the engine;

a compression ratio setting apparatus for configuring the engine in selected ones of the compression ratio operating states; and a controller in communication with said sensors and said compression ratio apparatus, said controller comprising computer program means for inferring a torque output for the engine based at least in part on the compression ratio operating state of the engine, as well as upon the engine speed and airflow, with said computer program means determining at least one predefined indicated torque value based on the engine speed, the air flow and the compression ratio operating state of the engine.

16. The system according to claim 15, wherein said controller further comprises computer program means for estimating a brake torque of the engine using the indicated torque and baseline engine friction loss values.

17. An article of manufacture for operating an internal combustion engine having a plurality of compression ratio operating states, the article of manufacture comprising:

a computer usable medium; and a computer readable program code embodied in the computer usable medium for inferring a torque output for the engine based at least in part on the compression ratio operating state of the engine, as well as upon the engine speed and air flow.

* * * * *